United States Patent [19]

Carroll

[11] Patent Number: 5,037,542

[45] Date of Patent: Aug. 6, 1991

[54] PROTECTIVE GRATING WITH PIVOTING SECTIONS FOR CULVERT PIPE

[76] Inventor: Kenneth T. Carroll, 28 Independence Ct., Jackson, N.J. 08527

[21] Appl. No.: 419,111

[22] Filed: Oct. 10, 1989

[51] Int. Cl.[5] ..... B01D 35/02; E02B 5/08

[52] U.S. Cl. ..... 210/161; 137/527.8; 210/170; 404/2; 405/124

[58] Field of Search ..... 210/170, 153, 163, 249, 210/161, 162, 164; 404/2, 4, 5; 405/124, 125; 292/237; 137/527.8

[56] References Cited

U.S. PATENT DOCUMENTS

| | | | |
|---|---|---|---|
| 114,270 | 5/1871 | Dark | 210/163 |
| 231,544 | 8/1880 | Darst | 137/527.8 |
| 286,951 | 10/1883 | McBee | 210/163 |
| 1,220,123 | 3/1917 | Heybach | 404/4 |
| 2,970,697 | 2/1961 | Larson et al. | 210/163 |
| 3,086,655 | 4/1963 | Compton | 210/153 |
| 4,101,154 | 7/1978 | Kagstrom | 292/237 |
| 4,713,179 | 12/1987 | Goedderz, Sr. | 210/162 |
| 4,935,129 | 6/1990 | Wang | 210/163 |
| 4,942,898 | 7/1990 | Osowski | 405/124 |

FOREIGN PATENT DOCUMENTS

| | | | |
|---|---|---|---|
| 9678 | 10/1853 | France | 210/163 |
| 607047 | 8/1948 | United Kingdom | 404/2 |

OTHER PUBLICATIONS

Websters New Riverside University Dictionary, Copyright 1983, Houghton Mifflin Company, p. 335.

*Primary Examiner*—Robert A. Dawson
*Assistant Examiner*—Joseph Drodge
*Attorney, Agent, or Firm*—Robert M. Skolnik

[57] ABSTRACT

A grating type pipe covering and protector which can be located either within the interior of a pipe or be attached to the outer walls of the pipe at its exit or its entrance openings includes a grating protector employing a two part grating covering having a common support about which both grating portions can pivot onto each other. Both parts of the grating covering have means thereon for affixing the grating to the walls of the culvert pipe.

3 Claims, 2 Drawing Sheets

PROTECTIVE GRATING WITH PIVOTING SECTIONS FOR CULVERT PIPE

FIELD OF THE INVENTION

This invention relates to a protective grating for culvert pipe so as to inhibit a variety of foreign objects from entering the pipe and interfering with its function and as a safety device to prevent persons from being trapped in the pipe by the suction generated in some culvert pipes when used in drainage facilities.

DESCRIPTION OF THE PRIOR ART

Compton U.S. Pat. No. 3,086,655 shows a hinged guard for a drain pipe. This is a removable guard which has a fixed mounting portion and a movable grating culvert blocking portion. Gustafson, et al. U.S. Pat. No. 3,262,487 discloses a two piece window well cover with a fixed vertical mounting portion and hinged movable screen portion. Feland U.S. Pat. No. 3,587,239 relates to a culvert end portion with a grating cover incorporated therein. Cannon, et al., U.S. Pat. No. 3,970,559 shows an openable drain guard for a pipe. Dumortier, U.S. Pat. No. 4,508,469 covers a two piece manhole cover with each half of the cover being openable independently of the other. Goedderz U.S. Pat. No. 4,713,179 shows a foldable two piece culvert covering for collecting and assisting in the removal of debris which collects beneath the covered culvert opening.

The prior art patents do not provide a culvert covering which provides ease of installation, access and removability occasioned by the two piece construction of the instant invention which permits either portion of the grating to be open by folding same onto the other closed portion about a common pivot.

SUMMARY OF THE INVENTION

The present invention consists of a grating type pipe covering and protector which can be located either within the interior of a pipe or be attached to the outer walls of the pipe at its exit or its entrance openings. The invention includes a grating protector employing a two part grating covering having a common support about which both grating portions can pivot onto each other. Both parts of the grating covering have means thereon for affixing the grating to the walls of the culvert pipe. This enables the grating cover to be partially open by overfolding either part onto the other about the common pivot.

To preserve drainage of water, culverts are frequently installed through road or other embankments. More recently, newer property development has included the construction of drainage collection pits of substantial depth and diameter. These pits are designed as drainage sumps to collect run off during periods of substantial rainfall (thus creating a temporary pond). Drainage from these temporary collection ponds is accomplished through a culvert pipe located at a drainage point in the pond. Recent heavy rainfall in the northeast has resulted in these drainage ponds being filled to substantial capacity resulting in a whirlpool effect in proximity to the mouth of the drain. This effect has caused death and injury of youths playing at or near the pond when they became caught in the whirlpool and were sucked into the pipe. These unfortunate incidents have caused an evaluation of the security and protection of these drainage facilities.

Further, blockage of the culvert results from a variety of materials as discussed in the prior art including beaver dams, and naturally occurring and man-made debris of all kinds.

A primary object of this invention is the provision of an improved guard grating for the passageway through a culvert pipe for preventing objects from moving through the pipe and blocking flow through the pipe. An important object of the invention is the provision of an protective grating with will enhance the safety of the drainage facility. Another object of my invention is the provision of a culvert pipe guard which can be affixed within the interior of the pipe or be affixed to the mouth of the pipe. A still further object of the invention is the provision of a culvert pipe guard which provided two openable portions both of which can open independently of the other about a common pivot.

BRIEF DESCRIPTION OF THE DRAWINGS

These as well as further objects and advantages of the invention will become apparent to those skilled in the art from a review of the following detailed specification of my invention, reference being made to the accompanying drawings in which.

DESCRIPTION OF THE PREFERRED EMBODIMENT

Figure 1:
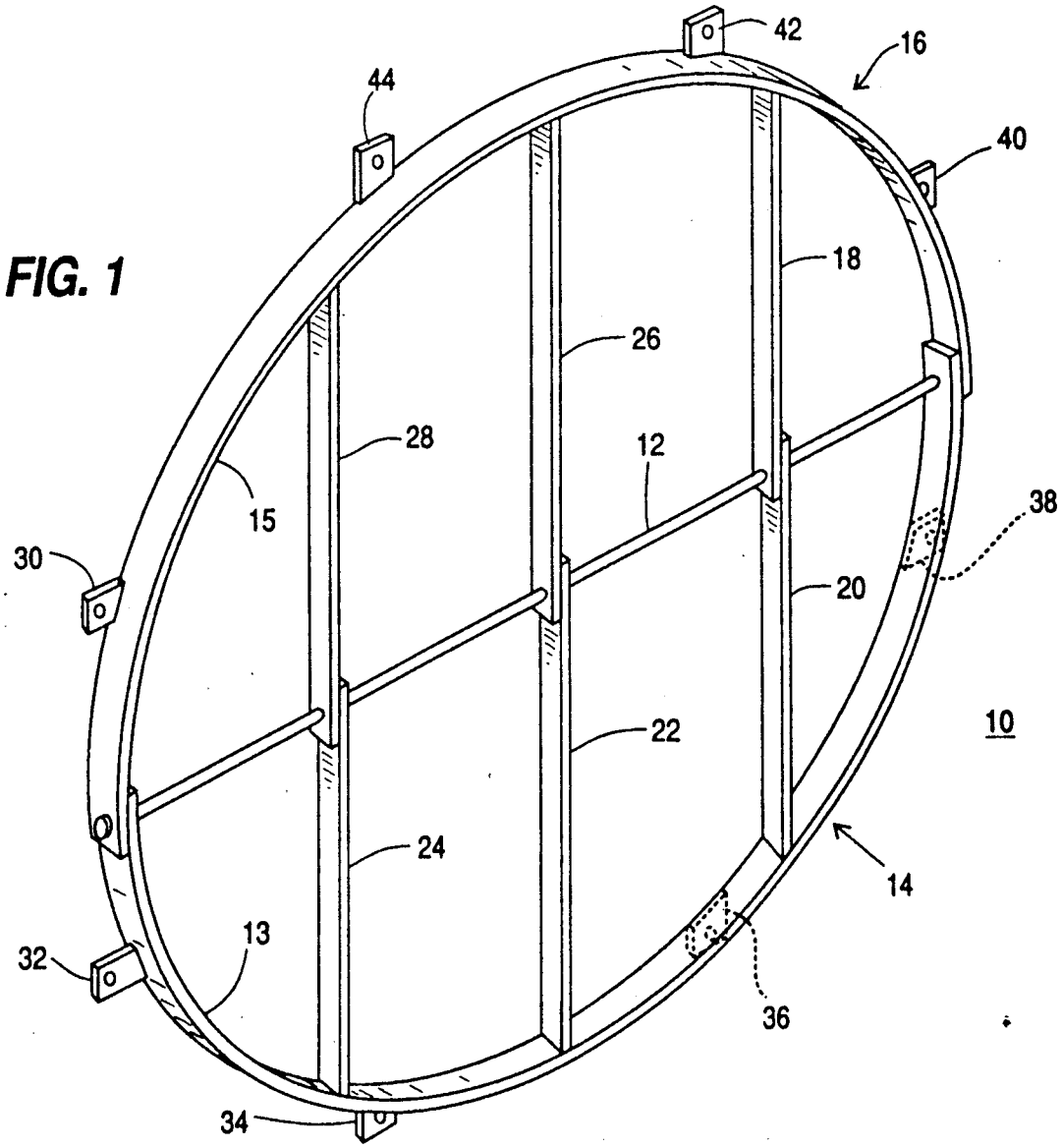
FIG. 1 is a plan view of the principal embodiment of my invention.
Figure 2:
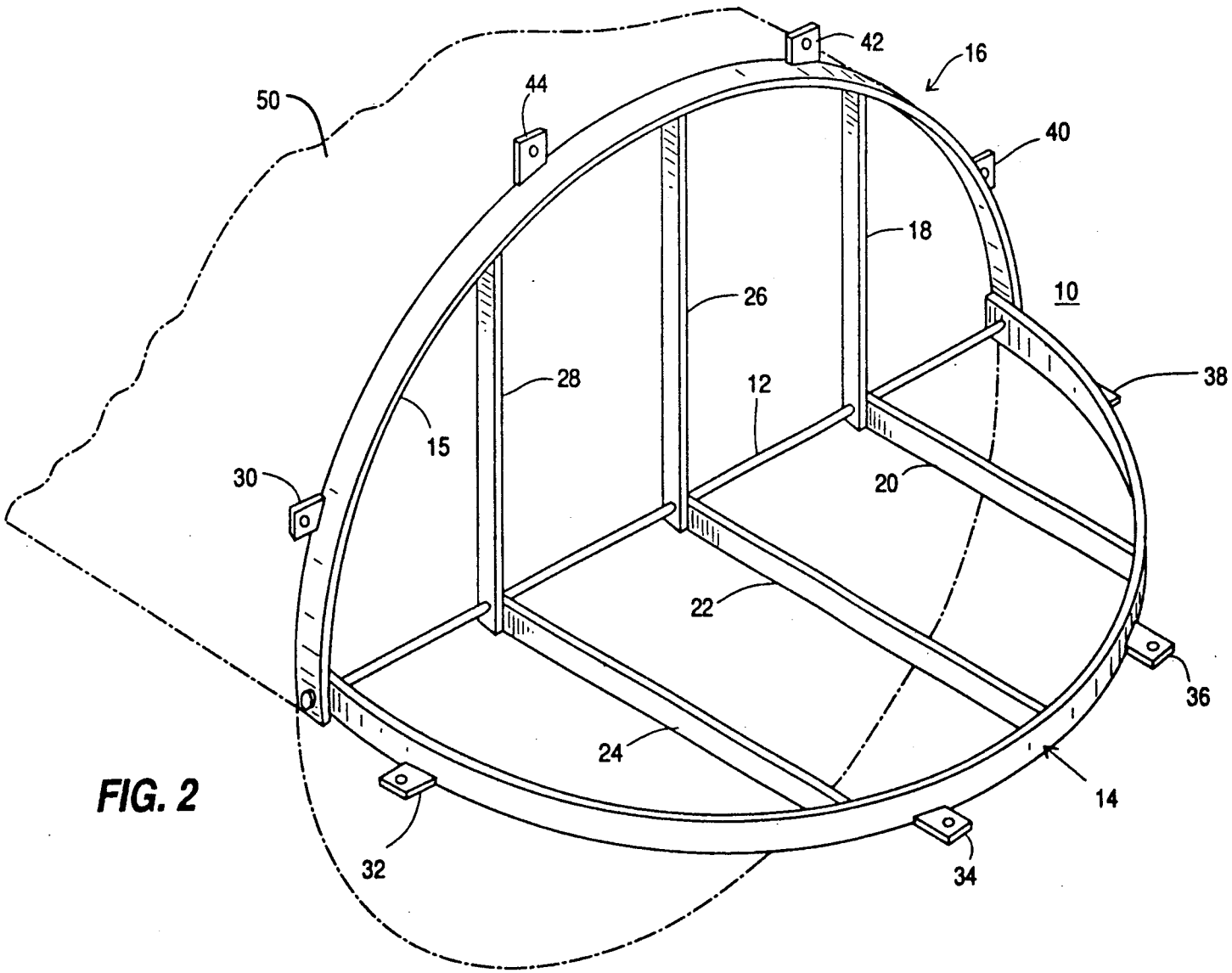
FIG. 2 is a perspective view of the invention mounted for use on a culvert pipe.

As shown in FIGS. 1 and 2, the protective grating of my invention is shown generally at 10. The grating consists of two portions, 14 and 16. In the embodiment of FIG. 1, the portions 14 and 16 are of a symmetrical configuration (i.e. of equal shape and dimensions). It will be understood however, that the portions 14 and 16 may be of different shape and/or different dimensions or otherwise asymmetrical.

Both of the portions 14 and 16 are formed of multiple bars 18, 26 and 28 for portion 16 and bars 20, 22 and 24 for portion 14. Each of the bars are pivotally attached to center bar 12. Rim 15 of portion 16 and rim 13 of grating portion 14 are also pivotally attached to center bar 12. Both of the portions 14 and 16 can thus be pivoted about bar 12 onto the other portion.

Connecting brackets 32, 34, 36 and 38 are affixed to portion 14 into rim 13. Connecting brackets 30, 40, 42 and 44 are affixed to portion 16 onto rim 15.

As shown in FIG. 2, the connecting brackets are used as required to connect the protective grating 10 to the culvert pipe 50.

As will now be seen, the protective grating 10 has a two piece construction which enables portion 16 or portion 14 to be open independently of the other portion. Thus, the grating can remain affixed to the pipe via the unopened portion while access to the area of the culvert pipe is obtained via the open portion.

As modifications to the foregoing may be made without departing from the spirit and scope of my invention, what is sought to be protected is set forth in the appended claims.

I claim:

1. A protective grating for a culvert pipe comprising: a mounting bar; a first grating portion pivotally connected to said mounting bar; a second grating portion pivotally connected to said mounting bar; said first and second grating portions each including a plurality of spaced elongated bars having a first end and a second end; each of said elongated bars being pivotally connected to said mounting bar at said first end; support and stabilizing means connecting each of said second ends of each of said elongated bars together; each of said support and stabilizing means having two ends, each of said ends pivotally connected to said mounting bar, and bracket means connected to each of said support and stabilizing means for mounting said protective grating on a culvert pipe.

2. A protective grating comprising: a mounting bar; first and second grating means pivotally connected to said mounting bar for movement about said mounting bar onto each other; said first and second grating portions each including a plurality of spaced elongated bars having a first end and a second end; each of said elongated bars being pivotally connected to said mounting bar at said first end; support and stabilizing means connecting each of said second ends of each of said elongated bars together; each of said support and stabilizing means having two ends, each of said ends pivotally connected to said mounting bar, and separate mounting brackets respectively connected to said first and second grating means.

3. A protective covering which permits fluid to pass therethrough comprising: a mounting bar; a first portion pivotally connected to said mounting bar; a second portion pivotally connected to said mounting bar; said first and second portions each including a plurality of spaced elongated bars having a first end and a second end; each of said elongated bars being pivotally connected to said mounting bar at said first end; support and stabilizing means connecting each of said second ends of each of said elongated bars together; each of said support and stabilizing means having two ends, each of said ends being pivotally connected to said mounting bar and separate mounting brackets respectively connected to said first portion and to said second portion, each of said portions being arranged to permit fluid to pass therethrough.

* * * * *